US006101738A

United States Patent [19]

Gleason

[11] Patent Number: 6,101,738

[45] Date of Patent: Aug. 15, 2000

[54] SLUDGE DEWATERING SYSTEM AND METHOD

[76] Inventor: Gary Gleason, 8 Wash St., Trumansburg, N.Y. 14886

[21] Appl. No.: 09/122,734

[22] Filed: Jul. 27, 1998

[51] Int. Cl.[7] ..... F26B 3/08

[52] U.S. Cl. ..... 34/362; 34/580; 34/216; 34/217

[58] Field of Search ..... 34/181, 216, 217, 34/236, 329, 334, 361, 362, 500, 502, 509, 580; 210/704, 297; 209/173; 110/224, 226, 227, 228; 432/103, 108, 110, 118

[56] References Cited

U.S. PATENT DOCUMENTS

| | | | |
|---|---|---|---|
| 4,067,318 | 1/1978 | Flaith et al. | 34/208 |
| 4,169,787 | 10/1979 | Gunnerson | 209/173 |
| 4,181,616 | 1/1980 | Bahr | 210/297 |
| 4,402,834 | 9/1983 | Bastgen et al. | 34/57 A |
| 4,419,834 | 12/1983 | Scott | 34/57 A |
| 4,664,813 | 5/1987 | Schneider | 210/771 |
| 4,827,853 | 5/1989 | Emery | 110/223 |
| 4,869,823 | 9/1989 | Otani et al. | 210/349 |
| 5,357,881 | 10/1994 | Elcik et al. | 110/346 |
| 5,426,866 | 6/1995 | Rumocki | 34/321 |
| 5,454,176 | 10/1995 | Gobel et al. | 34/135 |
| 5,463,819 | 11/1995 | Komori | 34/135 |
| 5,470,472 | 11/1995 | Baird et al. | 210/391 |
| 5,527,458 | 6/1996 | Gehrmann et al. | 210/177 |
| 5,534,159 | 7/1996 | Krieger | 210/704 |
| 5,609,709 | 3/1997 | Krieger | 210/704 |
| 5,755,973 | 5/1998 | Krieger | 210/704 |
| 5,770,056 | 6/1998 | Deskins | 210/136 |
| 5,913,590 | 6/1999 | Backus | 34/502 |

FOREIGN PATENT DOCUMENTS

| | | | |
|---|---|---|---|
| 2 058 291 | 6/1971 | Germany | 34/181 |

*Primary Examiner*—Denise L. Ferensic
*Assistant Examiner*—Andrea M. Joyce
*Attorney, Agent, or Firm*—Salzman & Levy

[57] ABSTRACT

A process and system for treating sludge are provided. Sludge is dewatered by introducing pressurized air to the sludge, while the sludge is being moved continuously. The air strips the sludge of its water, thus increasing total solids captured with respect to time. The throughput of the system is therefore also increased. In addition, the pressurized air passing through the sludge support purges contaminants from the pores of the support, thus keeping them clean without the necessity to backwash same.

8 Claims, 3 Drawing Sheets

SLUDGE DEWATERING SYSTEM AND METHOD

FIELD OF THE INVENTION

The present invention relates to a sludge dewatering system and method and, more particularly, to a system that forces air through the sludge as it is transported over a conveyor belt, in order to keep the conveyor belt clean, and for improving the throughput of the sludge treatment process.

BACKGROUND OF THE INVENTION

In most small sludge treating plants, it is not practical to use wash water to clean the sludge conveying belts. The wash water causes hydraulic problems. In a majority of plants, either large or small, the use of water results in calcium deposition in the conveyor belt material. This material build-up in the belt necessitates cleaning with an acid wash. For plants that do not have facilities for using effluent water for cleaning, the cost of clean water becomes prohibitive and is conservation inefficient.

Other belt cleaning schemes include the use of a scraper or doctor blade, which is passed over the belt filter press or over the gravity deck. The sludge is scraped off, but cleaning the belt still requires wash water to finish the cleaning process. The scraper or doctor blade, while scraping sludge from the surface of the belt, tends to force some solid into the belt. These solids eventually end up in the wash water, adding to the inefficiency of the process by removing less than the maximum amount of solids.

The present invention reflects the discovery that placing jets of forced air adjacently below the conveyor belt during sludge treatment removes excess water from the sludge. In so dewatering the sludge, the sludge dries out, and the conveyor belt is kept clean and free of sludge contaminants. The process greatly reduces or eliminates the need for wash water; the total solids captured is greatly enhanced. In addition, it has been found that this inventive technique significantly reduces the running time of the sludge treatment process. In other words, the throughput of the sludge treatment operation is greatly increased.

While jets can be used for applying air, most often a continuous slot is provided, often cut directly into the conduit. Practicality allows for the conduit, round or square, to be slotted with a (normally) ¼ inch opening about the width of the cloth to be cleaned. Using a square conduit, composite angle material is installed over the slot. These angle pieces are fastened to the conduit with screws or bolts in slotted openings so that they can be adjusted, thus changing the size (width) of the slot. End pieces are also installed at the point on each side of the belt that serves as a dewatering area. This prevents the air from blowing out of the sides of the system. Although a simple slot in the conduit, if pressed against the cloth, will clean the cloth as it passes over the slot, by installing the composite angle material, a sacrificial wear system is introduced. The preferred material is a composite plastic material, hard but slippery.

DISCUSSION OF RELATED ART

In U.S. Pat. No. 3,873,450, issued to LOVEGREEN, a dewatering system is illustrated wherein the material being dewatered is pressed between two moving belts. After pressing, the two belts are separated, and a scraper blade is used to remove the material. An air system is mounted downstream from the scraper blade, in order to blow contaminants from the belt. This air treatment technique contrasts with the invention in that the inventive process uses air during the sludge conveying. The air of the invention is used in lieu of the pressing technique, therefore eliminating that costly step.

In U.S. Pat. No. 4,158,627, issued to INGEMARSSON, a process for sludge treatment is shown, wherein sludge is carried vertically between two elongated plates. During the pressing step, air is blown through the sludge captured between the belts to enhance the dewatering process. Thereafter, the plates are separated and the dewatered sludge is removed from the belt.

In U.S. Pat. No. 4,830,750, issued to JANDOUREK et al, a process for separating water from a solid material is illustrated. Contaminated water containing solids is deposited onto an inclined, continuous belt. The belt is drawn upwardly through a first gravity drainage section, and then into a second drainage section. Air is then passed upwardly through the belt, reducing the amount of water contained in the remaining sediment. A curved shield mounted adjacent to the belt is used to intercept the air stream and to direct it over the belt in a forwardly moving direction. A second air stream is positioned above an inverted section of the belt, as it passes through a collection receptacle for the dewatered sediment. The second air stream is arranged to blow the remaining sediment downwardly into the receptacle.

In U.S. Pat. No. 5,209,841, issued to BRIATTEN, a liquid filtering system is depicted. Material being filtered is drawn on a filter belt into a pressurized chamber, where the water is removed. The belt is then removed from the chamber and the sediment is scraped from the belt by blades. Washer jets are positioned above and below the belt at the exit to the chamber, to clean the belt prior to scraping.

In U.S. Pat. No. 5,256,290, issued to BECKER et al, a system for recovering coolant used to cool a cutting tool is illustrated. The contaminated coolant is delivered into a tank and allowed to settle toward the bottom. Dirt, metal chips, and sludge are collected on a filter belt, which is drawn out of the tank. The belt is introduced into a drying chamber, where air is blown through the residue to enhance drying.

In all of the above patents, it is never suggested that pressurized air be introduced during the sludge treatment. Neither is it taught or suggested that this pressurized air treatment provide an improved throughput, as well as elimination or substantial reduction of the need for wash water to clean the sludge conveyor belt.

SUMMARY OF THE INVENTION

In accordance with the present invention, there is provided a sludge treatment process having improved throughput and efficiency. The sludge treatment process comprises dewatering of the sludge during its treatment by forcing pressurized air through the conveyor belt carrying the sludge. The air passing through the conveyor belt keeps the belt clean by deplugging the belt orifices. The air also removes water from the sludge, as the air passes therethrough. This greatly enhances solids capture, thus increasing the throughput, while eliminating or substantially reducing the need for wash water to subsequently clean the conveyor belt.

The sludge dewatering system of the invention comprises three embodiments. The first embodiment features a moving, porous, substantially horizontal belt, which is fed sludge from an overhead hopper. A plurality of air jets or other type of diffusor, slotted pipe or slotted pipe equipped with sacrificial contact angle material, is disposed below the porous belt, feeding air under pressure through the orifices of the belt into the sludge. The application of air to and through the filtrate material, moving belt or other system, may be accomplished through a slot or a slot equipped with a sacrificial and adjustable material such as angle plastic. The air causes the water in the sludge to be removed, which water runs off into a drip pan disposed below the moving belt. The filtrate from the drip pan is carried off by a conduit. The dewatered sludge discharge is further air processed, as the belt passes over a rotating discharge drum.

In a second embodiment of the invention, the porous conveyor belt is inclined at an upward angle of approximately fifteen to twenty degrees. The incline causes the dewatered sludge to move backwardly under the influence of a gravity vector component.

In a third embodiment, the invention comprises a vertically oriented, hollow, cylindrical drum. The air applicator rotates around the bottom of the drum but is pressed tightly to the cloth to maintain a continuous air flow up through the cloth, allowing water to escape through the cloth and constantly thickening the sludge. Because of the increased pressure resulting from the adjustable discharge port, the drum is equipped with a device that allows the cloth to be stretched tightly, so that the surface area exposed to the air diffusor is even. Sludge is introduced into the bottom of the drum. A porous cloth is disposed in the bottom of the drum, and receives pressurized air. The air is forced upwardly through the porous cloth into the sludge. The sludge is dewatered, the filtrate running off into a drip pan disposed below the drum. The thickened, dewatered sludge passes over an overflow weir disposed in the top of the drum. The dewatered sludge is then piped away through a sludge conduit.

It is an object of the present invention to provide a sludge treatment system having improved throughput.

It is another object of this invention to provide a sludge treatment process and system for dewatering the sludge by introducing pressurized air through a porous conveyor belt into the sludge.

It is a further object of the invention to provide a process and system for keeping the conveyor belt of a sludge treatment system clean, without the need for a water wash.

BRIEF DESCRIPTION OF THE DRAWINGS

A complete understanding of the present invention may be obtained by reference to the accompanying drawings, when considered in conjunction with the subsequent detailed description, in which.

For purposes of clarity and brevity, like elements and components will bear the same designation and numbering throughout the figures.

DESCRIPTION OF THE PREFERRED EMBODIMENT

Generally speaking, the invention features a process and system for treating sludge. The sludge is dewatered by introducing pressurized air to the sludge, while the sludge is being moved continuously along a conveyor belt. The air strips the sludge of its water, thus increasing total solids captured over time, and hence, the throughput of the system. In addition, the pressurized air passing through the conveyor belt will purge contaminants from the pores of the belt, thus keeping the belt clean.

Figure 1A:
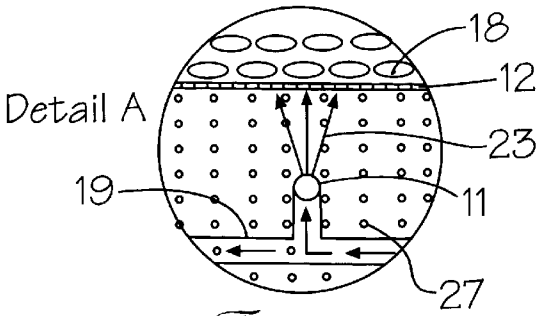
FIG. 1*a* shows an enlarged sectional view of the conveyor belt, illustrated in FIG. 1.
Figure 1:
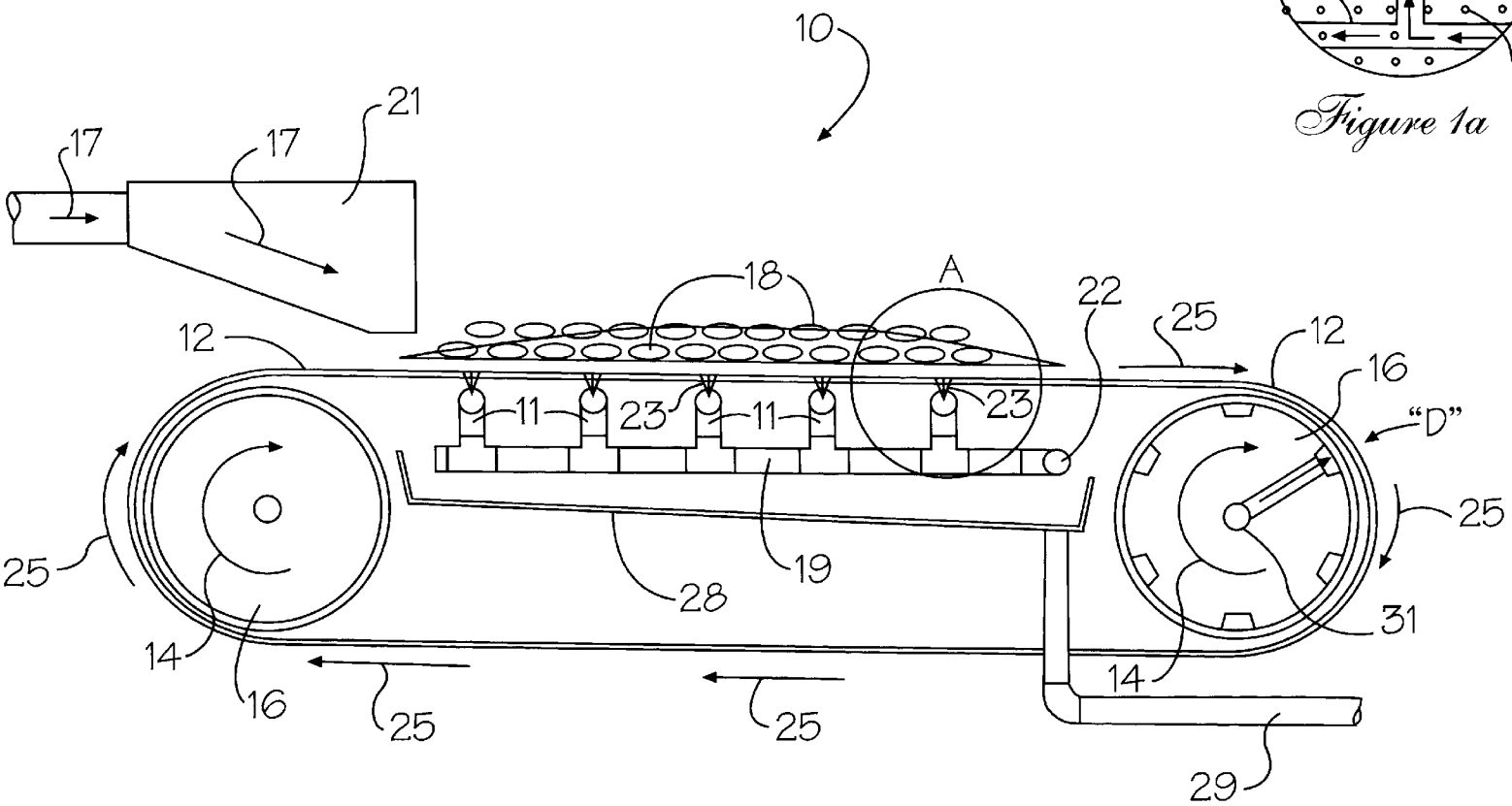
FIG. 1 illustrates a schematic, front view of a first embodiment of a sludge treatment system, in accordance with the invention.

Now referring to FIG. 1, a schematic diagram of a first embodiment of the sludge system 10 of this invention is illustrated. The sludge system 10 comprises a porous conveyor belt 12, which is supported upon two rotating (arrows 14) distally located drums 16. Sludge 18 to be treated by system 10 is introduced (arrows 17) to the upper surface of belt 12, by means of a sludge feed hopper 21. Air 23 under pressure is directed upwardly into the sludge 18, through the orifices of the porous belt 12, as shown in greater detail in FIG. 1*a*.

The air 23 is delivered to the sludge 18 by means of an elongated conduit 19, having a number of equally spaced injector pipes 11 disposed directly below the belt 12, as shown. The conduit 19 receives its air through the inlet 22. The sludge 18 moves past the air injector pipes 11, as the conveyor belt 12 moves clockwise upon rotating drums 16, as shown by arrows 25. A variety of configurations of pipe assembly may be used, but the one described hereinabove is a preferred embodiment.

The pressurized air 23 keeps the orifices of the belt 12 open, and strips the water contained in the sludge 18. The water carrying filtrate 27 then soaks through the porous belt 12, as shown in greater detail in FIG. 1*a*. The filtrate 27 is then collected in the drip pan 28. The accumulated filtrate 27 in the drip pan 28 is siphoned off by conduit 29. Air 23 is injected into the discharging sludge 18 at point "D" on the righthand side of the conveyor belt 12, via the air inlet 31 disposed internally within drum 16. This further dries the sludge 18.

Figure 2A:
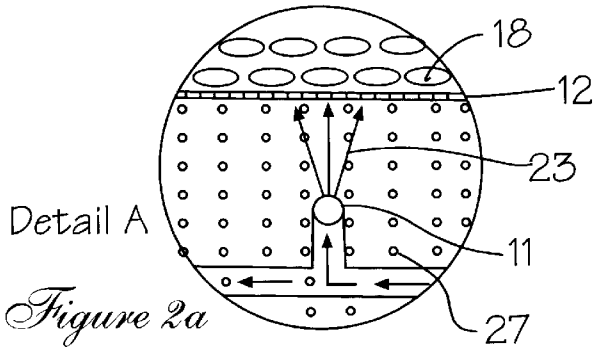
FIG. 2*a* shows an enlarged sectional view of the conveyor belt, illustrated in FIG. 2.
Figure 2:
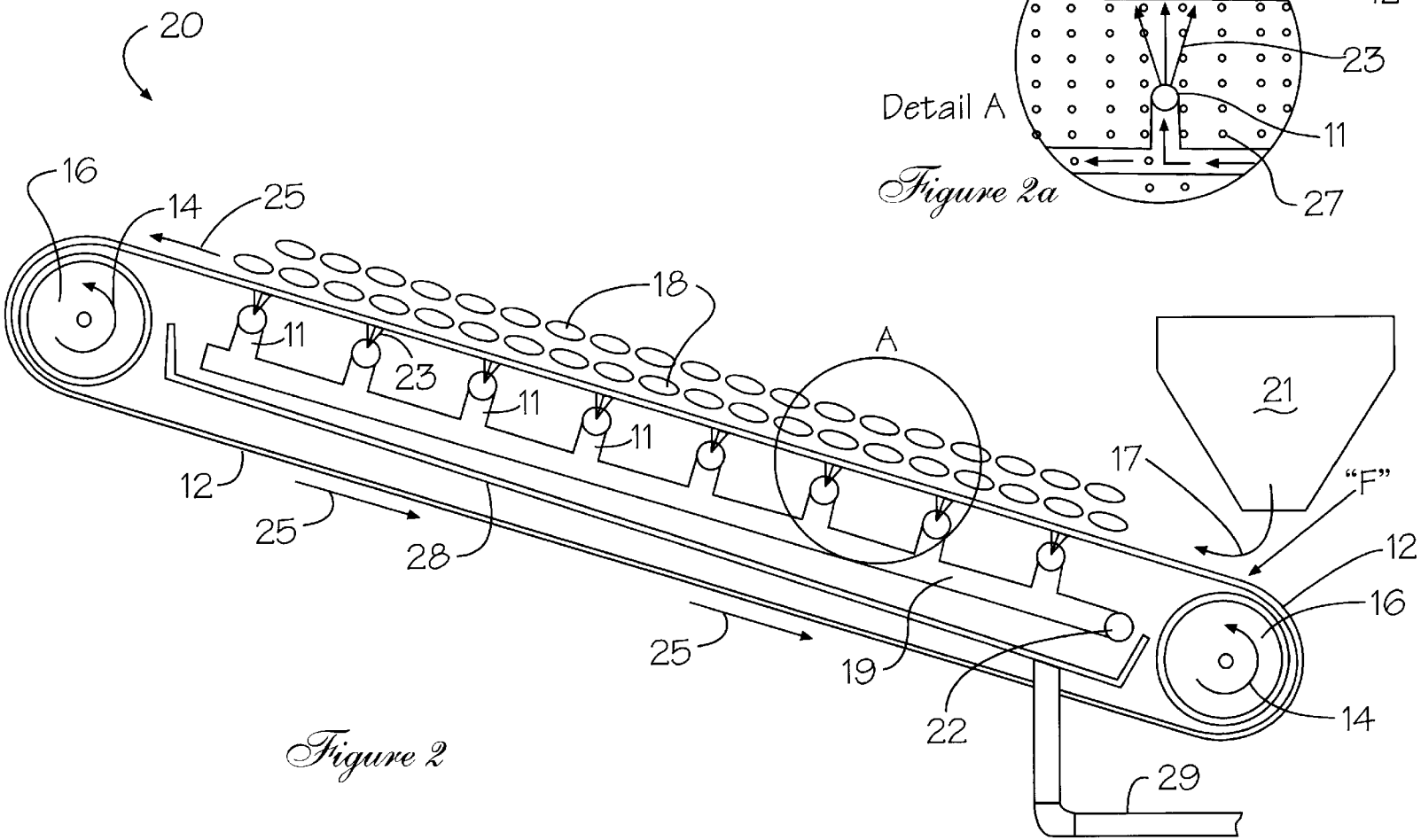
FIG. 2 depicts a schematic, front view of a second embodiment of a sludge treatment system, in accordance with the invention.

Referring to FIGS. 2 and 2*a*, the second embodiment of the sludge treatment system 20 is illustrated. The conveyor belt 12 is now angled at approximately 15 or 20 degrees from the horizontal plane, as shown. The sludge 18 is introduced (arrow 17) at the bottom of conveyor belt 12 at point "F", and travels upwardly on the moving (arrows 25) conveyor belt 12, against a vector force of gravity. Air 23 is injected under pressure, as before, into the sludge 18 through the porous belt 12. The air 23 strips the sludge 18 of its water, and the filtrate 27 is gathered in the drip pan 28 and carried off by conduit 29 as previously described.

Figure 3:
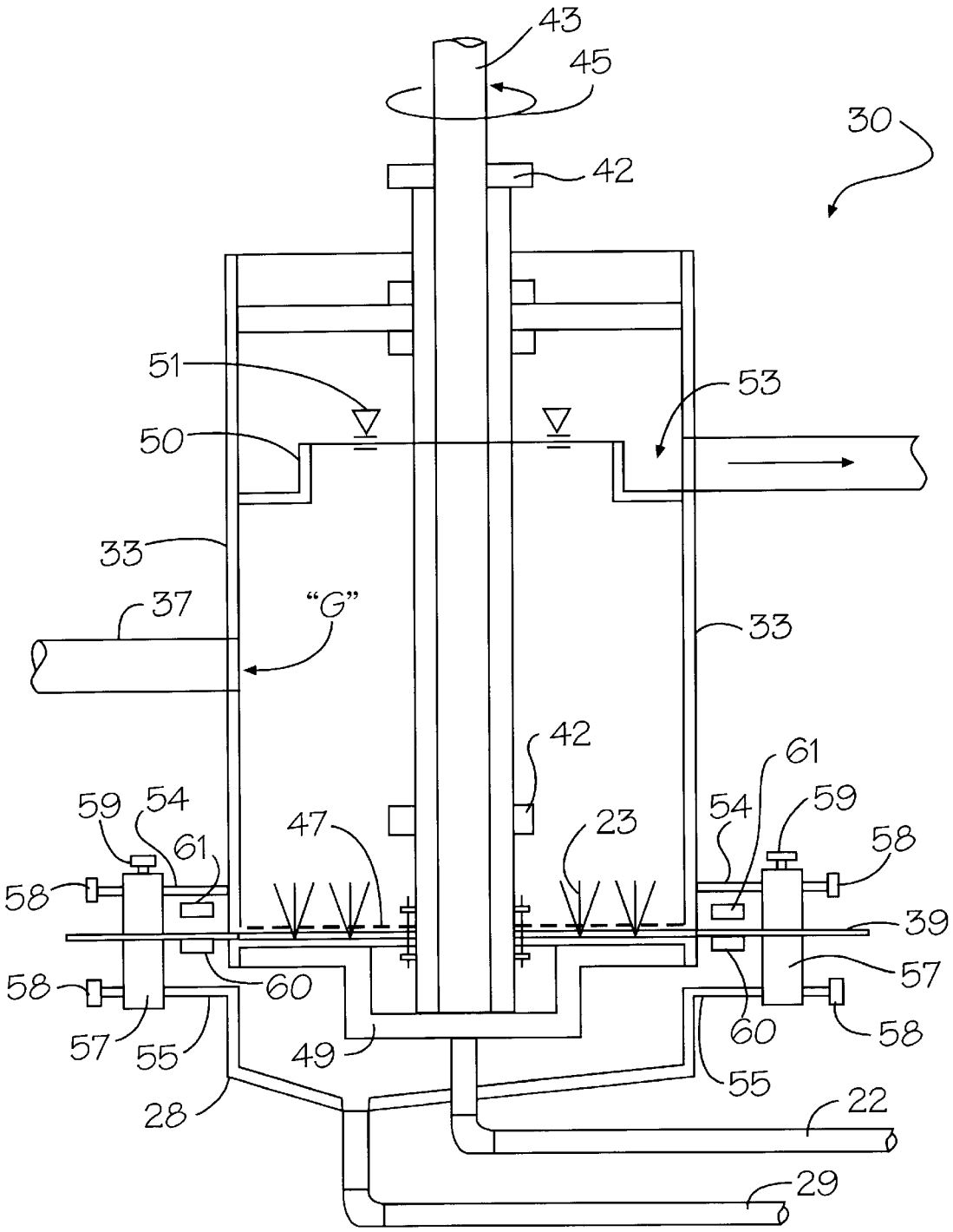
FIG. 3 illustrates a schematic, front view of a third embodiment of a sludge treatment system, in accordance with the invention.

Referring to FIG. 3, the third embodiment 30 of the invention, including a rotating cylindrical container 33, is shown. Sludge 18 is introduced at the bottom of the container 33 at point "G", via sludge inlet 37. The bottom of the container 33 is lined with a porous cloth or filter 39, overlaid with a mesh screen 47, upon which the sludge 18 is deposited as it enters the container 33 at point "G". The container 33 is mounted for rotation upon two support bearings 42, as shown. The air diffusor or sparger rotates on the bottom of the container 33 against the filter 39. The container 33 is fabricated with flanges 54 at the bottom which are married to flanges 55. The filtrate collection pan 28 is fabricated with said flanges 55. The flanges are held together with a belt 57 which can be tightened by means of belt tighteners 58 and 59 well known in the art. The fiber filter 39 is stretched past the flanges 55 and secured therebetween with bolts 60 and 61. A drive shaft 43 runs through the middle of the container 33, and is keyed to the container 33 causing it to rotate (arrow 45).

Pressurized air 23 is again injected into the sludge 18 via cloth filter 39 and mesh screen 47. The filtrate runoff from the sludge 18 is caught in the drip pan 28, and is piped away via conduit 29. The air 23 is introduced into container 33 by means of the air inlet 22, which feeds the rotating distribution arm 49, which in turn forces pressurized air 23 into the sludge 18.

An overflow weir 50 is disposed at the top of the container 33. The overflow weir 50 is adjustable, thus changing the detention time and pressure exerted on the filter 39. The sludge 18 rises to a predetermined level 51 at the top of the weir 50, then flows over into the sludge basin 53, and then out the sludge outlet pipe 52.

Each of the embodiments provides improved throughput and cleaning of the belts, screens, and cloth without resorting to any substantial afterwash. The air pressure is in the range of approximately 5 to 10 psig.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A sludge treatment system having improved throughput, comprising:

discharge means for discharging dried sludge;

movable, porous support means for supporting water-containing sludge for movement toward said discharge means, said movable porous support means including a continuous, movable, porous belt that delivers said dried sludge to said discharge means;

aeration means disposed adjacent said movable, porous support means for introducing air under pressure through said movable, porous support means and into said sludge supported thereupon, said aeration means stripping said water-containing sludge of water contained therein, said aeration means including a plurality of spaced apart pipes having air jets disposed therein; and means disposed adjacent said movable, porous support means for catching said water stripped from said sludge by said aeration means.

2. The sludge treatment system in accordance with claim 1, wherein said movable belt is inclined with respect to a horizontal axis, and said sludge is introduced upon said inclined belt for movement against a gravity vector force.

3. The sludge treatment system in accordance with claim 1, wherein said means for catching said water comprises a drip pan disposed below said continuous, movable, porous belt.

4. The sludge treatment system in accordance with claim 1, wherein said means for catching said water comprises a drip pan disposed below said a rotating hollow drum.

5. The sludge treatment system in accordance with claim 1, wherein said discharge means comprises a discharge drum over which said belt passes.

6. A method of improving the throughput of a sludge treatment system, comprising the steps of:

a) introducing water-containing sludge for movement past a pressurized air station, said pressurized air station delivering pressurized air into said water-containing sludge, and stripping said water-containing sludge of water contained therein, thereby enhancing total captured solids with respect to time, and whereby said throughput of said sludge treatment system is improved;

b) catching said water stripped from the sludge;

c) conveying the water-stripped sludge to a discharge station;

d) discharging said water-stripped sludge.

7. The method of improving the throughput of a sludge treatment system in accordance with claim 6, wherein said air is introduced into said sludge at a pressure in the range of approximately 5 to 10 psig.

8. The method of improving the throughput of a sludge treatment system in accordance with claim 6, further comprising the step of:

supporting said water-containing sludge upon a porous substrate, and wherein said pressurized air is forced through said porous substrate into said sludge.

* * * * *